US006837197B2

(12) United States Patent
Cecur

(10) Patent No.: US 6,837,197 B2
(45) Date of Patent: Jan. 4, 2005

(54) DUAL VALVE LIFT AND VALVE DEACTIVATION

(75) Inventor: Majo Cecur, Marshall, MI (US)

(73) Assignee: Eaton Corporation, Cleveland, OH (US)

( * ) Notice: Subject to any disclaimer, the term of this patent is extended or adjusted under 35 U.S.C. 154(b) by 0 days.

(21) Appl. No.: 10/392,007

(22) Filed: Mar. 19, 2003

(65) Prior Publication Data

US 2004/0182340 A1 Sep. 23, 2004

(51) Int. Cl.[7] ..... F01L 1/34
(52) U.S. Cl. ..... 123/90.16; 123/90.15
(58) Field of Search ..... 123/90.16, 90.46, 123/90.15, 90.17, 90.27, 90.39, 90.31, 90.41, 90.44, 90.45

(56) References Cited

U.S. PATENT DOCUMENTS

| | | | | |
|---|---|---|---|---|
| 4,762,096 A | | 8/1988 | Kamm et al. | 123/90.16 |
| 5,189,997 A | | 3/1993 | Schneider | 123/90.16 |
| 5,386,806 A | | 2/1995 | Hurr et al. | 123/90.16 |
| 5,501,186 A | | 3/1996 | Hara et al. | 123/90.16 |
| 5,660,153 A | | 8/1997 | Hampton et al. | 123/90.16 |
| 5,960,756 A | * | 10/1999 | Miyachi et al. | 123/90.16 |
| 6,321,704 B1 | | 11/2001 | Church et al. | 123/90.16 |

FOREIGN PATENT DOCUMENTS

| | | | | |
|---|---|---|---|---|
| JP | 361118513 A | * | 6/1986 | 123/90.39 |

* cited by examiner

*Primary Examiner*—Thomas Denion
*Assistant Examiner*—Zelalem Eshete
(74) *Attorney, Agent, or Firm*—L. J. Kasper

(57) ABSTRACT

A valve control system (13) for an internal combustion engine including a cylinder head (11), and a poppet valve (15). A camshaft (21) has a first cam profile (25) and a second cam profile (27), and a rocker arm assembly (29) includes a first cam follower (49) and a second cam follower (61) engageable with the second cam profile (27). The poppet valve (15) is disposed toward a first axial end of said rocker arm assembly (29), and there is a first fulcrum surface (39) toward a second axial end of the rocker arm assembly. The first and second axial ends of the rocker arm assembly are oppositely disposed about the first (49) and second (61) cam followers, and a first lash compensation device (83) is operably associated with the cylinder head and includes a first plunger (97) in engagement with the first fulcrum surface (39). The valve control system (13) is characterized by the rocker arm assembly (29) defining a second fulcrum surface (59) disposed axially between the first fulcrum surface (39) and the cam followers (49,61). A second lash compensation device (85) is operably associated with the cylinder head and includes a second plunger (99) in engagement with the second fulcrum surface (59) of the rocker arm assembly (29). Each of the first (83) and second (85) lash compensation devices is selectively switchable between a latched condition (FIG. 1) and an unlatched condition.

6 Claims, 6 Drawing Sheets

DUAL VALVE LIFT AND VALVE DEACTIVATION

BACKGROUND OF THE DISCLOSURE

The present invention relates to a valve control system for an internal combustion engine, and more particularly, to such a system which can vary the operational characteristics of an engine poppet valve, in accordance with various operational modes of the engine.

Variable valve control systems for engine poppet valves are already generally well known in the art. Although such variable valve control systems can be applied to either the intake poppet valve, or the exhaust poppet valve, or both, it is most common to utilize such a variable valve control system to vary the "lift" (the amount of opening of the engine poppet valve) of only the intake poppet valves, and the invention will be described in connection with such an arrangement.

A "dual lift" valve control system is known from U.S. Pat. Nos. 4,762,096 and 5,660,153, both of which are assigned to the assignee of the present invention and incorporated herein by reference. In a typical dual lift valve control system, there is a low lift condition in which the poppet valve opens a relatively small amount while the engine is operating at relatively lower speeds, and a high lift condition in which the poppet valve opens a relatively large amount while the engine is operating at relatively higher speeds. Normally, such dual lift valve control systems require some sort of actuator (typically an electromagnetic or electro-hydraulic actuator) to move a latch member between unlatched (low lift) and latched (high lift) conditions. Although such dual lift valve control systems have shown the ability to perform in a generally satisfactory manner, there are many vehicle applications in which it is desirable to be able to select from among a greater range of lift options than merely "high" lift and "low" lift.

Also now well know to those skilled in the art are valve control systems of the type including "valve deactivation" capability. One embodiment of a valve deactivation control system is illustrated and described in U.S. Pat. No. 6,321,704, also assigned to the assignee of the present invention and incorporated herein by reference. In the valve deactivation system of the cited patent, there is an hydraulic lash adjuster (HLA) which may be operated in either: (i) a latched condition, in which case the rotation of the camshaft will result in normal valve lift, or (ii) an unlatched condition, introducing lost motion into the valve gear train, whereby rotation of the camshaft will result in very little lift, or more commonly, no lift at all of the engine poppet valve. Such valve deactivation systems have now started to enjoy a certain amount of commercial success, although the required latching mechanism, and the associated controls, add substantially to the cost of the engine valve train, especially considering that the result is merely a choice between normal lift and valve deactivation.

As is well know to those skilled in the art, in a typical dual lift valve control system, the dual lift capability would be provided for each and every cylinder. For example, on a V-8 engine, all eight of the intake poppet valves (assuming one intake valve per cylinder) would be provided with a dual lift valve control system, and normally, all of the intake poppet valves would operate "together", i.e., all would be in the low lift mode or all would be in the high lift mode, at any given point in time.

On the other hand, on engines having valve deactivation capability (also referred to as "cylinder deactivation"), only a portion of the cylinders are deactivated. For example, on a V-8 engine, it would be typical to provide the intake poppet valves, and the exhaust poppet valves, for two of the cylinders on each bank with valve deactivation capability so that, as the engine speed and load reach predetermined values, all of the valves for those two cylinders of each bank would be deactivated, such that the engine then operates on four cylinders (i.e., as a "V-4" engine) at highway speeds and low throttle loads.

On certain vehicle engines, it would be desirable to provide both dual lift and valve deactivation capability. Unfortunately, based upon the known prior art, to provide even half of the engine poppet valves with both dual lift and valve deactivation capability would result in a valve control system which would be prohibitively expensive, and in many engine applications, would provide substantial packaging problems. The above disadvantage of the prior art is even more of a problem if, instead of "cylinder deactivation", it is desired to provide true "valve deactivation", and it will be understood that references hereinafter to "deactivation" will mean and include both cylinder-type and valve-type deactivation. In a true valve deactivation system, there would be two intake poppet valves per cylinder, and deactivation would be provided for one (typically, the "tumble" intake valve) of the two intake valves on each cylinder. Thus, the problems noted above regarding cost and packaging would be exacerbated by requiring deactivation capability on all eight cylinders.

BRIEF SUMMARY OF THE INVENTION

Accordingly, it is an object of the present invention to provide an improved valve control system for an internal combustion engine having both dual lift capability and valve (or cylinder) deactivation capability.

It is a more specific object of the present invention to provide such an improved valve control system which achieves the above-stated object in a manner which is economically feasible and at the same time is feasible in terms of the overall packaging of the valve control system.

It is a further object of the present invention to provide such a valve control system which achieves the above-stated objects, but which does not require a separate actuator for each cylinder, or for each poppet valve being controlled, and which is able to use the same structure to achieve both the dual lift and the deactivation.

The above and other objects of the invention are accomplished by the provision of an improved valve control system for an internal combustion engine including a cylinder head and a poppet valve moveable relative to the cylinder head between open and closed positions. A camshaft has a first cam lobe profile and a second cam lobe profile formed thereon. The valve control system comprises a rocker arm assembly including a first cam follower engageable with the first cam lobe profile and a second cam follower engageable with the second cam lobe profile. The rocker arm assembly defines a valve pad in engagement with a stem tip portion of the poppet valve, and disposed toward a first axial end of the rocker arm assembly, and further defines a first fulcrum surface toward a second axial end of the rocker arm assembly, the first and second axial ends being oppositely disposed about the first and second cam followers. A first lash compensation device is operably associated with the cylinder head and includes a first plunger in engagement with the first fulcrum surface of the rocker arm assembly.

The improved valve control system is characterized by the rocker arm assembly defining a second fulcrum surface disposed axially between the first fulcrum surface and the cam followers. A second lash compensation device is operably associated with the cylinder head and includes a second plunger in engagement with the second fulcrum surface of the rocker arm assembly. Each of the first and second lash compensation devices is selectively switchable between a latched condition and an unlatched condition.

DETAILED DESCRIPTION OF THE PREFERRED EMBODIMENT

Figure 1:
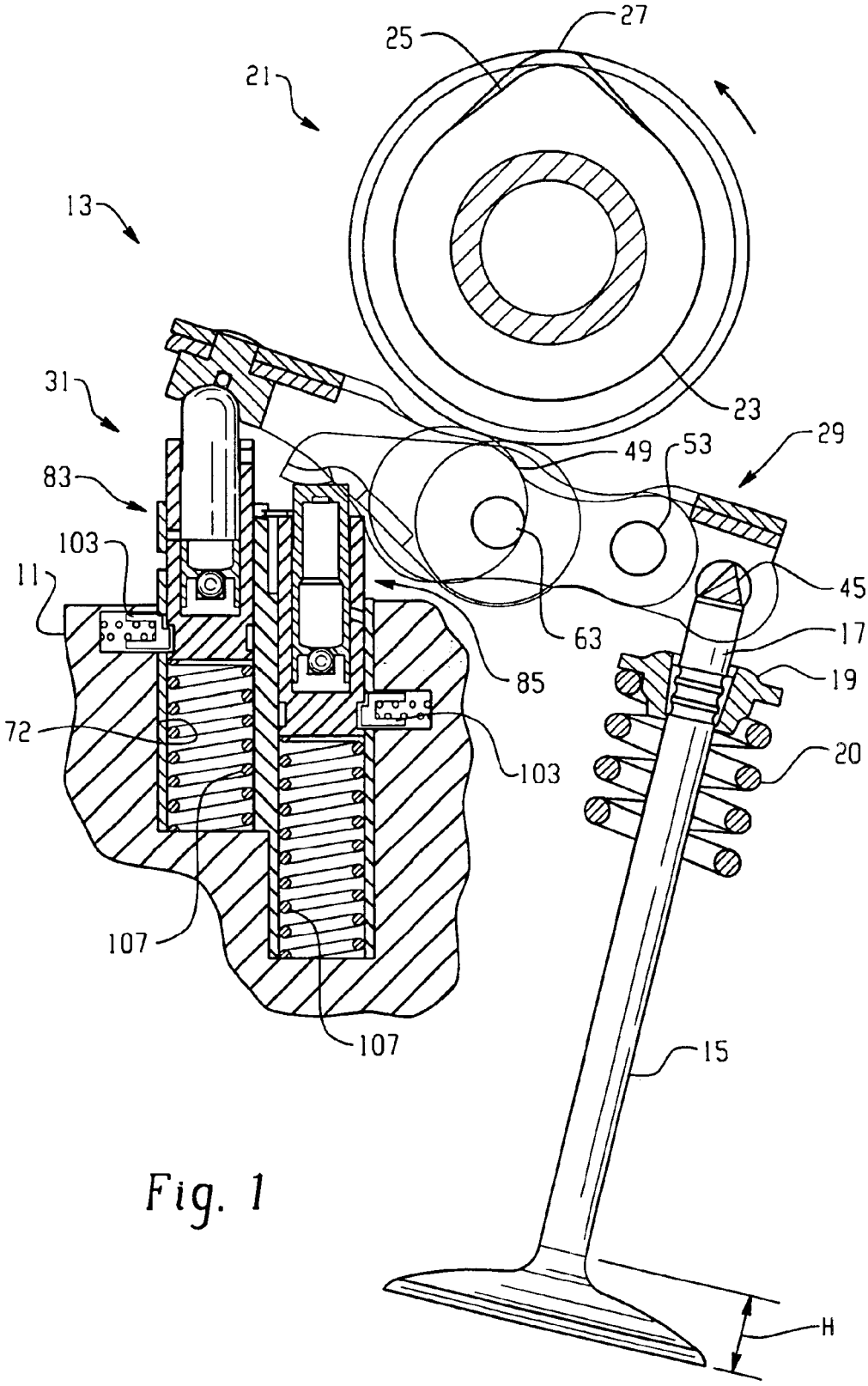
FIG. 1 is a fragmentary, somewhat schematic plan view, partially in transverse cross-section, of a valve control system made in accordance with the present invention.

Referring now to the drawings, which are not intended to limit the invention, FIG. 1 illustrates, somewhat schematically, a portion of a cylinder head 11 of an internal combustion engine of the overhead cam (OHC) type which incorporates the valve control system of the present invention. In FIG. 1, the valve control system is generally designated 13, and is utilized to control the movement ("lift") of an engine poppet valve 15. As was mentioned in the BACKGROUND OF THE DISCLOSURE, the valve control system 13 of the present invention would typically be used to control and vary the lift of an intake poppet valve, rather than an exhaust poppet valve. The engine poppet valve 15 includes a tip portion 17 surrounded by a spring retainer 19 which, as is well know to those skilled in the art, serves as the seat for the upper end of a valve return spring 20 (shown only fragmentarily herein).

The valve control system 13 operates in conjunction with a camshaft, generally designated 21, to provide cyclical opening motion to the engine poppet valve 15, in opposition to the biasing force of the valve return spring 20. The camshaft 21 includes a base circle portion 23, a first, low lift cam profile 25 and a second, high lift cam profile 27. As will be understood from the subsequent description of the invention, typically there would be one of the high lift cam profiles 27 and a pair of low lift cam profiles 25, disposed on axially opposite sides of the high lift cam profile 27. For purposes of the subsequent description, it will be assumed that the camshaft 21 is rotating counter-clockwise, as is shown by the arrow in FIG. 1.

The valve control system 13 of the present invention comprises two primary "subsystems", a rocker arm assembly, generally designated 29, and a hydraulic lash adjuster assembly, generally designated 31. Each of the assemblies 29 and 31 will now be described in greater detail.

It should be understood by those skilled in the art that the particular construction, shown and described hereinafter, of the rocker arm assembly 29, and of the HLA assembly 31 is by way of example only, and is not essential to the present invention, except as is specifically recited in the appended claims.

Figure 2:
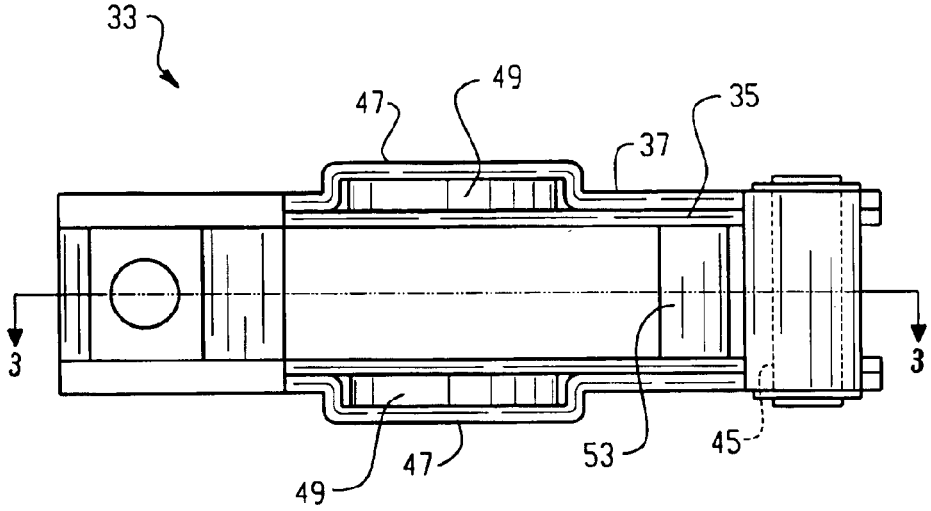
FIG. 2 is an enlarged, top plan view of the outer rocker arm assembly of the present invention.
Figure 3:
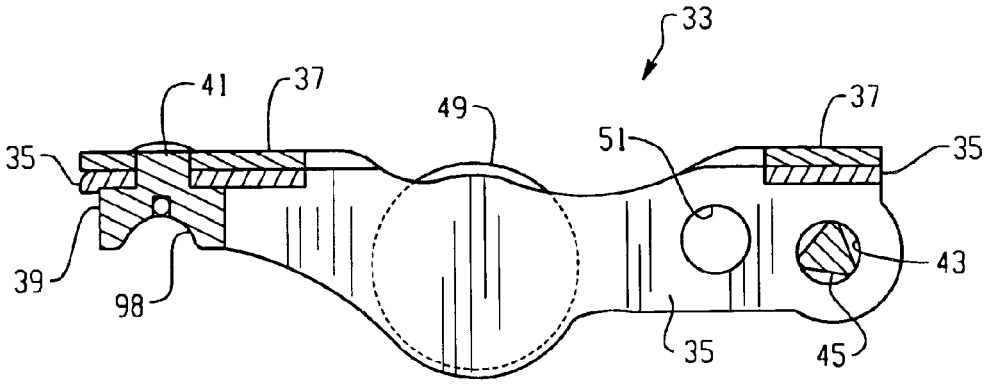
FIG. 3 is a longitudinal cross-section taken on line 3—3 of FIG. 2, and on substantially the same scale.

Referring now primarily to FIGS. 2 and 3, the rocker arm assembly 29 comprises an outer rocker arm subassembly, generally designated 33. The subassembly 33 includes an inner body member 35 and an outer body member 37. Each of the body members 35 and 37 is in the form of a downwardly-opening, generally U-shaped channel member. A first end of the rocker arm assembly 29 is disposed adjacent the poppet valve 15. At a second, axially opposite end (left end in FIGS. 2 and 3), the inner and outer body members 35 and 37 are joined together by a socket member 39 which includes a rivet portion 41. Toward the first end (right end in FIGS. 2 and 3), the body members 35 and 37 define aligned circular openings 43. Disposed within the openings 43 is a triangular "elephant's foot" member 45 (see FIGS. 1 and 3), the function of which is to ensure that for any orientation of the rocker arm assembly 29, there is face-to-face engagement between a top surface of the tip portion 17 of the poppet valve 15 and a surface of the elephant's foot member 45.

The outer body member 37 includes a pair of pocket portions 47 which are deformed laterally outward, out of the plane of the rest of the outer body member 37, and therefore, cooperate with the adjacent outer surface of the inner body member 35 to define openings or "pockets". In each of the pockets formed by the portions 47, there is disposed a generally cylindrical cam follower 49, each of the cam followers 49 being disposed for engagement with one of the low lift cam profiles 25. Although not shown herein, for simplicity of illustration, those skilled in the art will understand that, preferably, each of the cam followers 49 would rotate about a shaft, with the opposite ends of each of the shafts being received within mating openings in the adjacent wall portions of the inner body member 35 and the pocket portion 47. Such an arrangement is already well known in the art.

The inner and outer body members 35 and 37 also cooperate to define a pair of aligned circular openings 51 (see FIG. 3) and, upon assembly of the entire rocker arm assembly 29, there is disposed within the openings 51 an axle shaft 53 (see FIG. 2), the function of which will be described subsequently.

Figure 4:
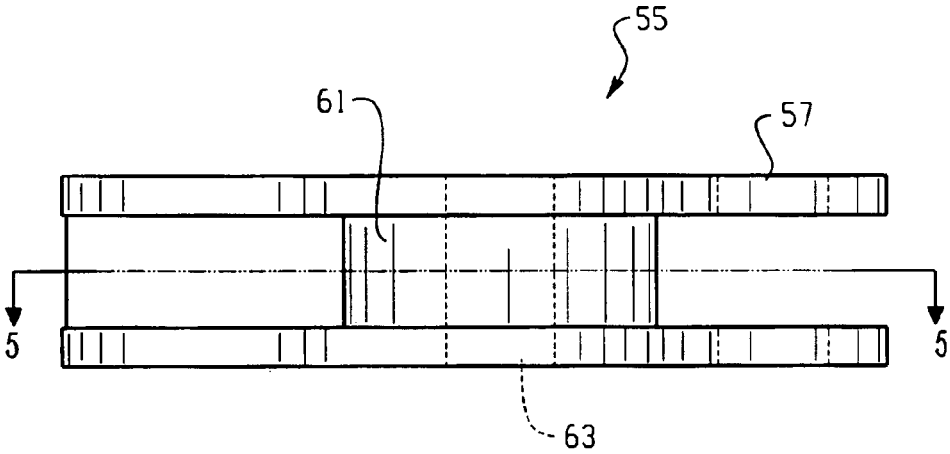
FIG. 4 is an enlarged, top plan view of the inner rocker arm of the present invention.
Figure 5:
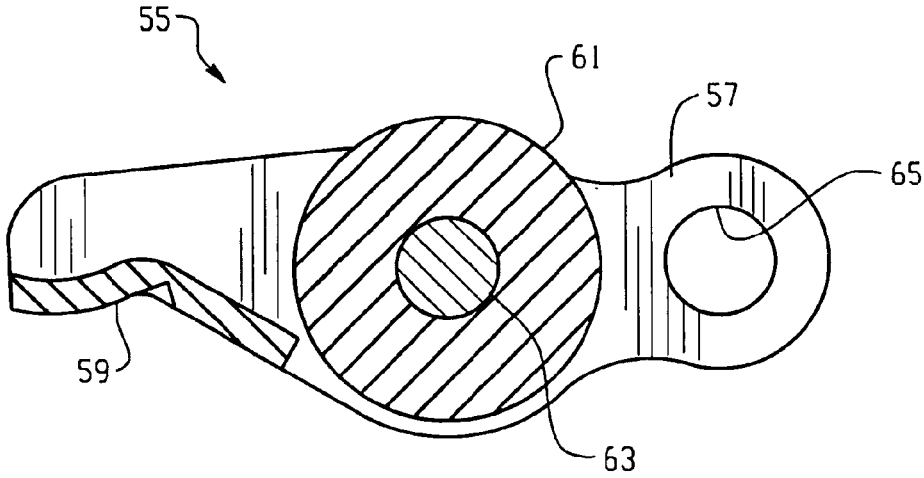
FIG. 5 is a longitudinal cross-section, taken on line 5—5 of FIG. 4, and on substantially the same scale.
Figure 6:
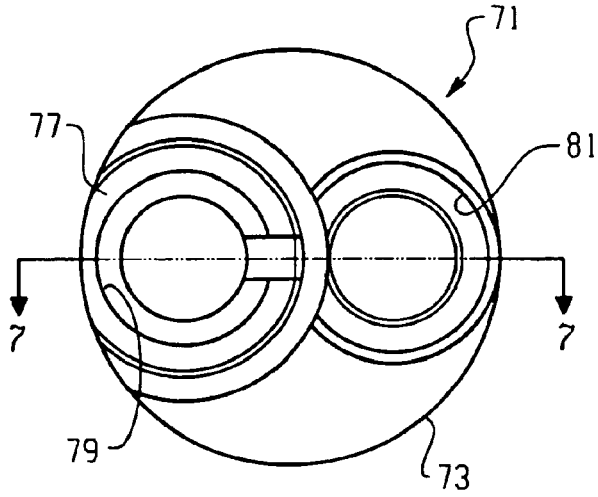
FIG. 6 is a top plan view of the lash adjuster assembly shown in FIG. 1.
Figure 7:
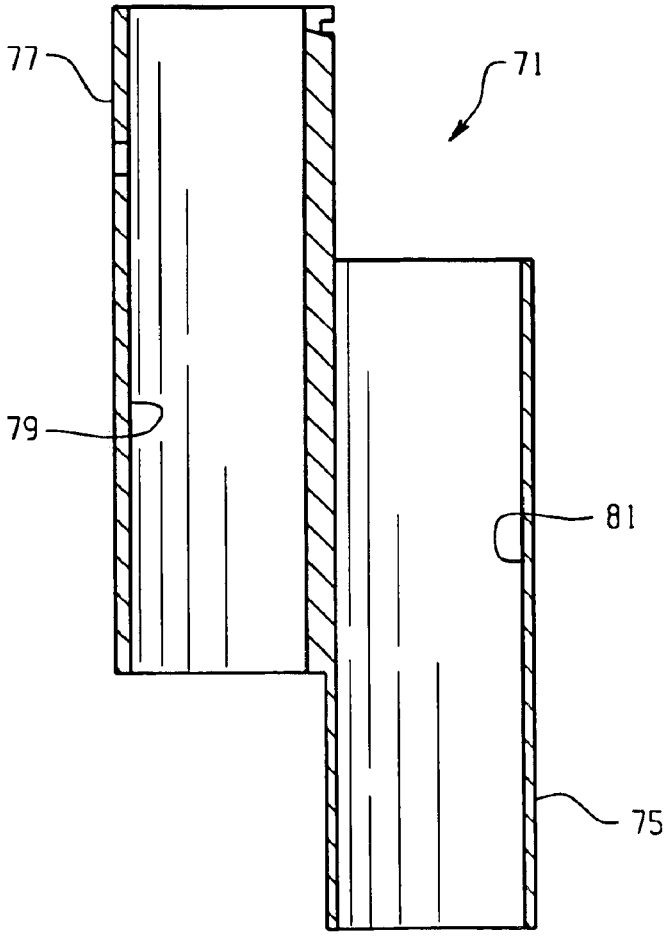
FIG. 7 is a vertical cross-section, taken on line 7—7 of FIG. 6, through the lash adjuster housing shown in FIG. 6, but with the lash adjusters removed for ease of illustration.

Referring now primarily to FIGS. 4 and 5, the rocker arm assembly 29 also includes an inner rocker arm subassembly, generally designated 55, which upon assembly of the entire rocker arm assembly 29, is disposed between the side walls of the inner body member 35 in a manner which is generally well known to those skilled in the art. The inner rocker arm subassembly 55 comprises a generally upwardly opening U-shaped member 57, in which the opposite side walls are joined by a bottom portion 59, the function of which will be described subsequently. Disposed between the adjacent sidewalls of the member 57 is a second, generally cylindrical cam follower 61, which is disposed to be in engagement with the high lift cam profile 27. The cam follower 61 is rotatably mounted on an axle shaft 63 which is received within mating openings in the sidewalls of the member 57. The sidewalls of the member 57 also define a pair of aligned circular openings 65 (see FIG. 5), which are substantially the same size as the openings 51 defined by the outer rocker arm subassembly 33, such that the axle shaft 53 passes through the openings 65. Therefore, in the subject embodiment, the inner rocker arm subassembly 55 is able to pivot, relative to the outer rocker arm subassembly 33, about the axis of the axle shaft 53.

Referring now primarily to FIGS. 6 through 9, the HLA assembly 31 will be described in some detail. The HLA assembly 31 comprises a housing member 71 which is received within a mating opening, generally designated 72 and shown in FIG. 1, the opening 72 being defined, in the subject embodiment, by the cylinder head 11. The housing member 71 includes a relatively larger cylindrical portion 73, received within a cylindrical portion of the opening 72 in the cylinder head 11. Extending downwardly from the cylindrical portion 73 is a relatively smaller cylindrical portion 75, and similarly, extending upwardly from the cylindrical portion 73 is another smaller cylindrical portion 77 (see also FIG. 6). The reason for the vertical "offset" of the cylindrical portions 75 and 77 in opposite directions, relative to main part of the cylindrical portion 73, may be better understood by viewing FIG. 1, and considering the geometry and function of the rocker arm assembly 29.

The housing member 71 is, in the subject embodiment, an investment cast part which is then subsequently machined to the configuration shown. The housing member 71 defines a first vertical bore 79 and a second vertical bore 81, the bores 79 and 81 preferably being parallel and having their center lines defining a plane (the plane of FIG. 7) which approximately coincides with the longitudinal axis of the rocker arm assembly 29. This would be the same plane as is defined by the lines 3—3 or FIG. 2 and lines 5—5 of FIG. 4. It should be understood that the housing member 71 could be eliminated, as a separate member, and the bores 79 and 81, and the various other recesses and bores required, could simply be machined in the head, but the provision of the separate housing member 71 is preferred.

Figure 8:
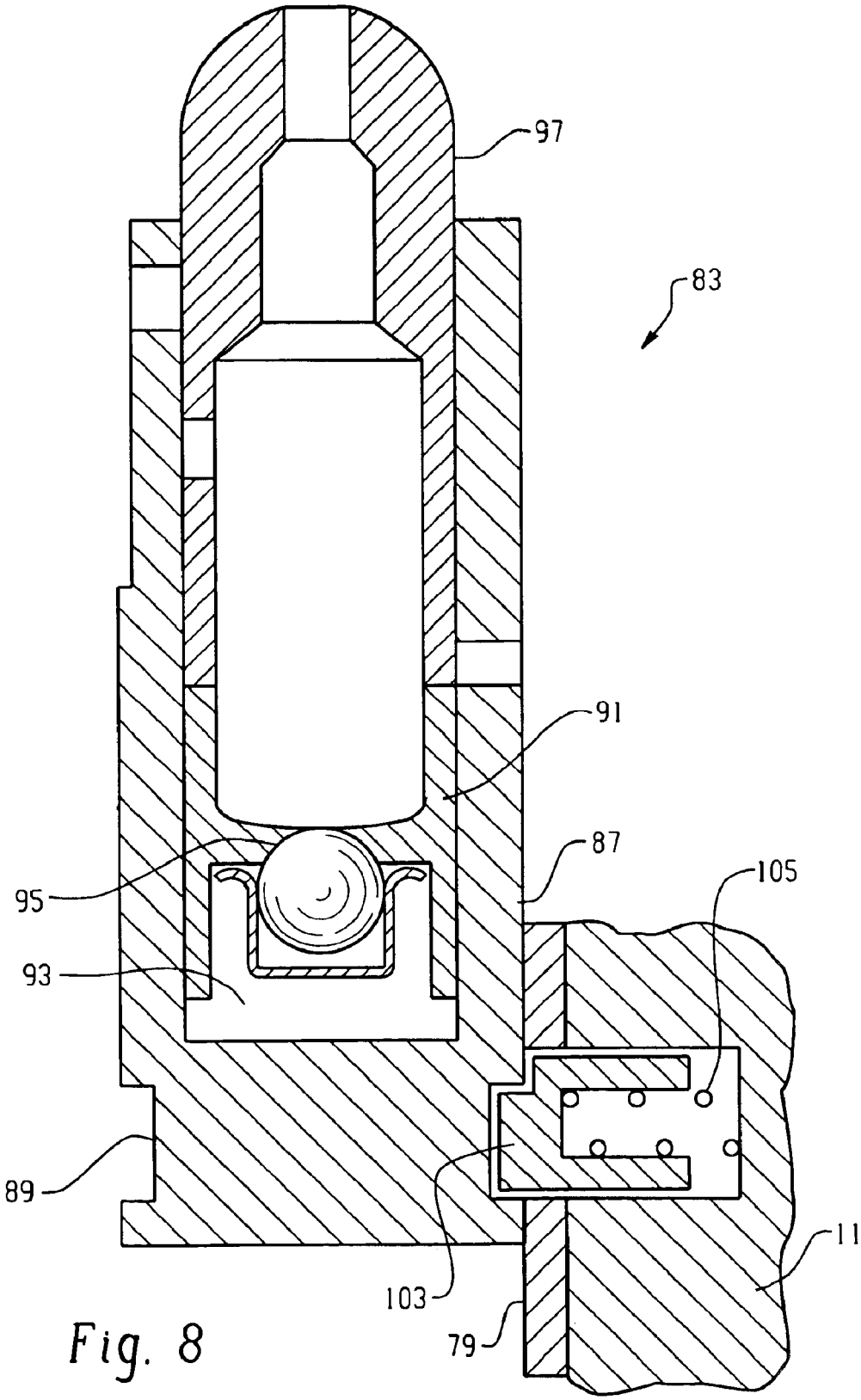
FIGS. 8 and 9 are axial cross-sections of the first and second lash adjusters which comprise part of the assembly shown in FIG. 6, but on a larger scale than in FIG. 6.
Figure 9:
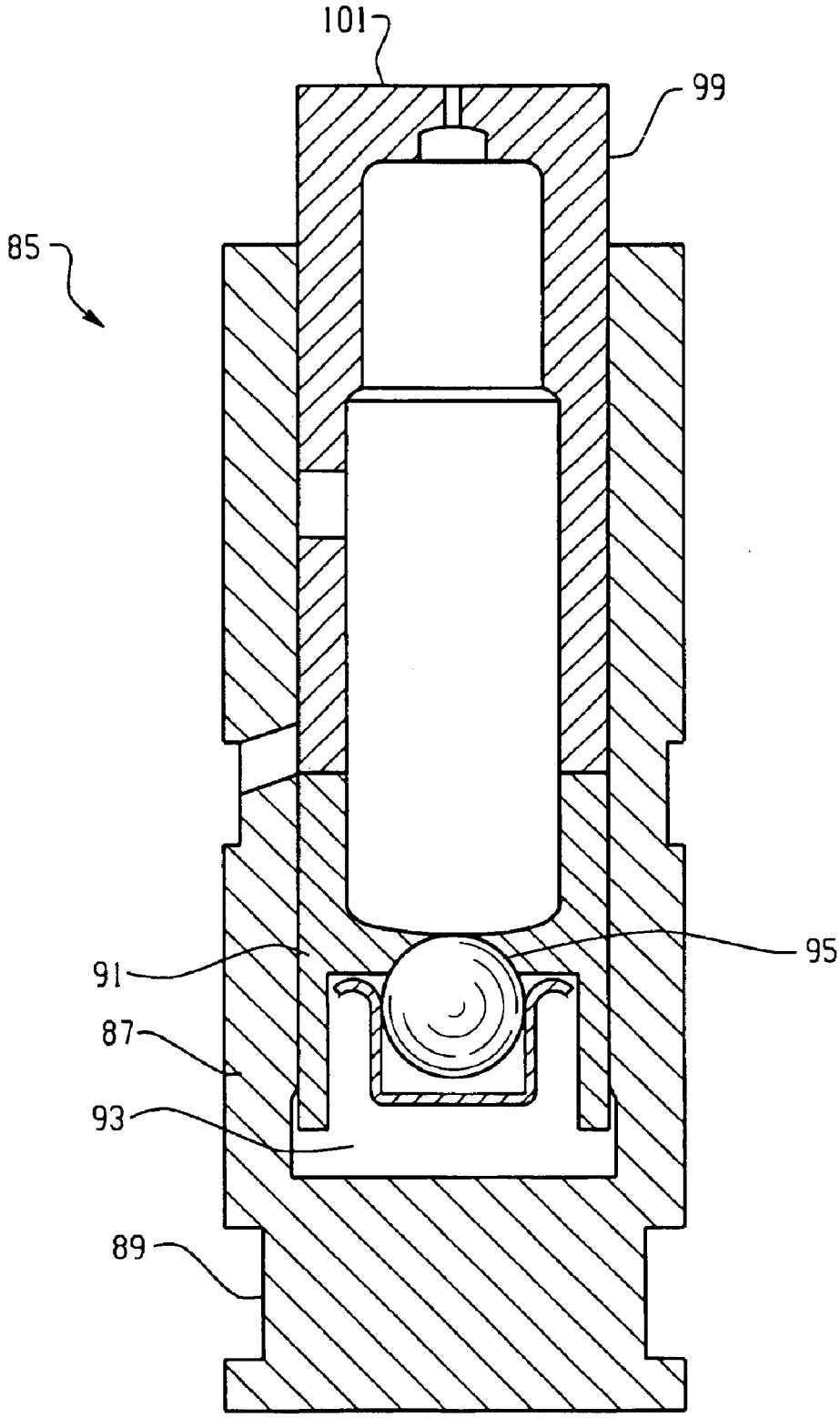

Disposed within the first bore 79 is a first lash compensation device 83 (see FIG. 8), and disposed within the second bore 81 is a second lash compensation device 85 (see FIG. 9). The lash compensation devices 83 and 85 (each of which is also referred to as a "hydraulic lash adjuster" or an "HLA") may be of the type which are generally well know to those skilled in the art, are nearly identical to each other, and therefore will be described only briefly hereinafter. It should be understood by those skilled in the art that the lash compensation devices 83 and 85 are functionally important elements of the overall valve control system 13, although the particular construction details shown herein are not essential, except as may be noted subsequently.

Each of the lash compensation devices 83 and 85, in the subject embodiment, and by way of example only, includes a body member 87 defining an annular groove 89. Disposed within the body member 87 is a lower plunger member 91 which cooperates with the body member 87 to define a high pressure chamber 93. The lower plunger member 91 also defines a seat surface for a ball check valve 95.

Referring now to FIGS. 1 and 3, in conjunction with FIG. 8, the lash compensation device 83 includes an upper plunger member 97 which comprises a ball plunger adapted to engage a mating, hemispherical surface 98 defined by the socket member 39, thus controlling any side load which may be imposed upon the rocker arm assembly 29. Referring now primarily to FIGS. 1 and 5, in conjunction with FIG. 9, the lash compensation device 85 includes an upper plunger 99 having a flat upper surface 101 which engages an undersurface ("fulcrum surface") of the bottom portion 59 of the inner rocker arm subassembly 55. As will be understood by those skilled in the art, the undersurface, or fulcrum surface (also referred to by the reference numeral "59") of the bottom portion 59 will engage in some sliding motion relative to the flat upper surface 101 of the lash compensation device 85, in view of the fact that the rocker arm assembly 29 is restrained from transverse movement, relative to the HLA 83, by the engagement of the ball plunger 97 and the hemispherical surface 98.

In accordance with one important aspect of the present invention, each of the first and second lash compensation devices 83 and 85 is selectively switchable between a latched condition, as shown in FIG. 1, and an unlatched condition, as will be described further. It should be understood that, although the latching arrangement illustrated and described herein is of the spring-biased to latch, pressure-biased to unlatch, such is not an essential feature of the invention. The particular details of the latching arrangement utilized form no part of the present invention, except as may be specifically set forth in the appended claims.

In the subject embodiment, and by way of example only, there is provided within the cylinder head 11 at least a pair of latch members 103 for each of the lash compensation devices 83 and 85, although for simplicity of illustration, only one of the latch members 103 is shown (in FIGS. 1 and 8) for each of the devices 83 and 85. As may best be seen in the somewhat fragmentary view of FIG. 8, each latch member 103 is, in the subject embodiment, biased radially inward by a compression spring 105, such that each latch member 103 engages the respective annular groove 89 and fixes the vertical position of the body member 87 within its respective bore 79 or 81. In a manner which is now well know to those skilled in the art, each of the lash compensation devices 83 and 85 can be switched from the latched condition shown in FIG. 1 to an unlatched condition by communicating pressurized engine oil into the annular groove 89, thus biasing the latch members 103 radially outward, in opposition to the force of the respective compression spring 105. However, as noted previously, the present invention is not limited to any particular arrangement for achieving the latching and unlatching of the lash compensation devices 83 and 85, and furthermore, there could be a different latching arrangement utilized for the HLA 83 than is used for the HLA 85. For example, the HLA 83 could be spring-biased toward the latched condition (as shown), while the HLA 85 could be spring-biased toward the unlatched condition, and moved toward the latched condition by some means such as electromagnetic actuation, or any other suitable means, the details of which form no essential part of this invention.

In the unlatched condition, the latch members 103 are retracted far enough radially such that they are out of engagement with the annular groove 89, thus permitting the lash compensation device (83 or 85) to move within its respective vertical bore (79 or 81). As is shown only in FIG. 1, in each of the vertical bores 79 and 81 there is a lost motion spring 107 biasing the body member 87 upward within the respective bore 79 or 81, toward the latched condition. Therefore, in the absence of fluid pressure biasing the latch members 103 radially outward, the lash compensation devices 83 and 85 will be biased to the upward, latched condition shown in FIG. 1, thus permitting the latch members to be biased into engagement with the groove 89 by the springs 105.

On the other hand, when there is pressure present in one of the grooves 89, the respective HLA (83 or 85) will be in the unlatched condition, such that rotation of the camshaft 21 will cause the particular HLA to move downward in its bore (79 or 81), in opposition to the force of its lost motion spring 107. As is well known to those skilled in the art of engine valve controls, the lost motion spring 107 is selected to provide less biasing force than the valve return spring 20 so that, when the HLA is unlatched, the respective rocker arm will pivot about the tip portion 17 of the poppet valve 15, and the end of the respective rocker arm engaging the HLA will move vertically up and down with the unlatched HLA (83 or 85).

Operation

Based upon the above explanation and understanding of how each individual HLA and rocker arm operate, depending upon whether the HLA is latched or unlatched, the operation of the entire valve control system of the present invention will now be described. The subsequent description of the operation of the valve control system will, for simplicity, be based upon the assumption of only a single intake poppet valve 15 per cylinder, and that what is shown in FIG. 1 is provided on one of the cylinders intended to have both dual lift and valve deactivation.

When the engine is operating at a relatively higher speed and/or at a relatively higher engine load, as those terms are generally understood in the art, the engine microprocessor (not shown herein) will provide a suitable command signal, resulting in the discontinuance of control pressure to the annular grooves 89. As a result, both the HLA 83 and the HLA 85 will be in the latched condition, as was described previously, and the high lift cam profile 27 will engage the second cam follower 61, causing the entire rocker arm assembly 29 to pivot about the point of engagement of the undersurface of the bottom portion 59 and the upper surface 101 of the HLA 85. With the rocker arm assembly 29 now pivoting about the HLA 85, which defines a shorter "lever arm", the high lift cam profile 27 causes a relatively larger valve lift to occur, as shown by the lift height designated "H" in FIG. 1. It should be noted that the entire valve control system 13 is shown in FIG. 1 in the high lift position, as though the camshaft 21 were rotated so that the high lift cam profile 27 would be engaging the second cam follower 61.

When the engine operates at a relatively lower engine speed and/or at a relatively lower engine load, the engine microprocessor will provide a suitable command signal, resulting in the presence of control pressure in the annular groove 89 of only the HLA 85, such that the HLA 85 will now be in the unlatched condition, whereas the HLA 83 will continue in the latched condition. With the HLA 83 and the HLA 85 in the particular combination of conditions described above, engagement of the high lift cam profile 27 with the cam follower 61 merely results in the inner rocker arm subassembly 55 pivoting (counterclockwise in FIG. 1) about the axle shaft 53, as described previously, causing the HLA 85 to move downward in its bore 81 once for each rotation of the camshaft 21, in opposition to the lost motion spring 107 associated with the HLA 85.

At the same time that the HLA 85 is engaging in "lost motion", as described previously, the HLA 83 remains in the latched condition, such that the entire rocker arm assembly 29 (and specifically, the outer rocker arm subassembly 33) will now pivot about the engagement of the plunger 97 and the hemispherical surface 98. This pivotal movement of the rocker arm assembly will occur in response to the low lift cam profiles 25 engaging the first cam followers 49, and because of the longer "lever arm" between the plunger 97 and the cam follower 49, and the lower "lift" provided by the cam profiles 25, the result is a relatively smaller valve lift height than the lift height "H" shown in FIG. 1.

When the engine is operating at very low load but is cruising at highway speeds, the poppet valve 15 may be operated in the valve deactivation ("cylinder deactivation") condition by providing a suitable command to communicate control pressure to the annular grooves 89 of both HLA 83 and HLA 85. In this condition, rotation of the camshaft 21 results in the outer rocker arm subassembly 33 pivoting about the elephant's foot member 45, while the inner rocker arm subassembly 55 pivots about the axle shaft 53, but with no motion being transmitted to the poppet valve 15. Instead, the poppet valve 15 remains in its closed position, under the influence of the return spring 20, while both the HLA 83 and the HLA 85 reciprocate in their respective bores 79 and 81, overcoming the biasing force of their respective lost motion springs 107, once per rotation of the camshaft 21.

The invention has been described in great detail in the foregoing specification, and it is believed that various alterations and modifications of the invention will become apparent to those skilled in the art from a reading and understanding of the specification. It is intended that all such alterations and modifications are included in the invention, insofar as they come within the scope of the appended claims.

What is claimed is:

1. A valve control system for an internal combustion engine including a cylinder head, and a poppet valve moveable relative to said cylinder head between open and closed positions; a camshaft having a first cam profile and a second cam profile formed thereon; said valve control system comprising a rocker arm assembly including a first cam follower engageable with said first cam profile and a second cam follower engageable with said second cam profile; said rocker arm assembly defining a valve pad in engagement with a stem tip portion of said poppet valve, and disposed toward a first axial end of said rocker arm assembly, and further defining a first fulcrum surface toward a second axial end of said rocker arm assembly, said first and second axial ends being oppositely disposed about said first and second cam followers; a first lash compensation device operably associated with said cylinder head and including a first plunger in engagement with said first fulcrum surface of said rocker arm assembly; characterized by:

(a) said rocker arm assembly defining a second fulcrum surface disposed axially between said first fulcrum surface and said cam followers;

(b) a second lash compensation device operably associated with said cylinder head and including a second plunger in engagement with said second fulcrum surface of said rocker arm assembly;

(c) each of said first and second lash compensation devices being selectively switchable between a latched condition and an unlatched condition, whereby, when said first lash compensation device is in said latched condition, rotation of said camshaft and engagement of said first cam profile with said first cam follower imparts a first, low valve lift to said poppet valve; and (d) when both of said first and second lash compensation devices are in said unlatched condition, rotation of said camshaft, and engagement of at least one of said cam profiles with the respective one of said cam followers, imparts no valve lift to said poppet valve.

2. A valve control system as claimed in claim 1, characterized by, when said second lash compensation device is in said latched condition, rotation of said camshaft, and engagement of said second cam profile with said second cam follower, imparts a second, high valve lift to said poppet valve.

3. A valve control system as claimed in claim 1, characterized by said rocker arm assembly including a first, outer rocker arm defining said first cam follower, and a second, inner rocker arm defining said second cam follower.

4. A valve control system as claimed in claim 3, characterized by said first, outer rocker arm, defining said first fulcrum surface, and said second, inner rocker arm (55) defining said second fulcrum surface.

5. A valve control system as claimed in claim 3, characterized by said first, outer rocker arm and said second, inner rocker arm being interconnected by means operable to permit relative pivotal movement of said rocker arms at a pivot location disposed axially between said cam followers and said valve pad.

6. A valve control system for an internal combustion engine including a cylinder head, and a poppet valve moveable relative to said cylinder head between open and closed positions; a camshaft having a first cam profile and a second cam profile formed thereon; said valve control system comprising a rocker arm assembly including a first cam follower engageable with said first cam profile and a second cam follower engageable with said second cam profile; said rocker arm assembly defining a valve pad in engagement with a stem tip portion of said poppet valve, and disposed toward a first axial end of said rocker arm assembly, and further defining a first fulcrum surface toward a second axial end of said rocker arm assembly, said first and second axial ends being oppositely disposed about said first and second cam followers; a first lash compensation device operably associated with said cylinder head and including a first plunger in engagement with said first fulcrum surface of said rocker arm assembly; characterized by:

(a) said rocker arm assembly defining a second fulcrum surface disposed axially between said first fulcrum surface and said cam followers;

(b) a second lash compensation device operably associated with said cylinder head and including a second plunger in engagement with said second fulcrum surface of said rocker arm assembly;

(c) each of said first and second lash compensation devices being selectively switchable between a latched condition and an unlatched condition, whereby, when said first lash compensation device is in said latched condition, rotation of said camshaft and engagement of said first cam profile with said first cam follower imparts a first, low valve lift to said poppet valve; and (d) said poppet valve having a return spring biasing said poppet valve toward said closed position, and said first and second lash compensation devices including first and second lost motion springs, respectively, biasing said first and second plungers, respectively, toward positions in which said plungers may be in said latched conditions, said return spring for said poppet valve having a greater spring force than said first and second lost motion springs.

* * * * *